United States Patent [19]

Swain

[11] Patent Number: 4,750,233

[45] Date of Patent: Jun. 14, 1988

[54] SPONGE MOP ATTACHMENT

[75] Inventor: Henry L. Swain, Bedminister, N.J.

[73] Assignee: Illinois Tool Works, Inc., Chicago, Ill.

[21] Appl. No.: 97,750

[22] Filed: Sep. 17, 1987

[51] Int. Cl.[4] ..... A47L 13/20; A47L 13/24

[52] U.S. Cl. ..... 15/118; 15/228; 15/231; 15/246; 15/244.1

[58] Field of Search ..... 15/114, 116 A, 119 A, 15/228, 231, 232, 244 R, 244 A, 244 B, 246, 104.94

[56] References Cited

U.S. PATENT DOCUMENTS 2,698,955 1/1955 Trindl ..... 15/228 X 3,199,136 10/1965 George ..... 15/228 X

FOREIGN PATENT DOCUMENTS 482840 4/1952 Canada ..... 15/233

*Primary Examiner*—Edward L. Roberts

*Attorney, Agent, or Firm*—J. P. O'Brien; T. W. Buckman

[57] ABSTRACT

For use with a sponge mop, a pad, a frame adapted to be removably attached to the sponge mop, the frame being provided with integral structure forming one part of a two-part interlocking assembly adapted to removably attach the pad to the frame, and a locking member forming the other part of said assembly and being adapted to interlock with said one part of said assembly. In certain embodiments including a preferred embodiment, in which the pad is a compressible pad, a portion of the pad is compressed between the interlocked parts of said assembly. In other embodiments, in which the pad may but does not have to be compressible, the locking member is affixed to the pad. In each embodiment, said assembly is one of a pair of similar assemblies.

13 Claims, 2 Drawing Sheets

SPONGE MOP ATTACHMENT

BACKGROUND OF THE INVENTION

This invention pertains to an attachment for a sponge mop.

Typically, a sponge mop comprises a cellulose or other synthetic sponge, which is shaped as a rectangular parallelipiped, and to a top surface of which an elongated handle is attached so as to extend at an acute angle from the top surface.

Although sponge mops are ideal for many cleaning and other tasks, such as floor washing and waxing tasks, sponge mops may be too soft for some scrubbing tasks, even if used with powdered cleansers containing fine particles of grit. Moreover, if used for hard scrubbing tasks, and especially if used with such cleansers, sponge mops tend to wear quickly, even to tear apart or crumble. Likewise, sponge mops may be too hard for some polishing tasks.

It would be desirable, therefore, to provide attachments, such as scrubbing pads and polishing pads, which could be removably attached to a sponge mop.

It has been proposed to provide a frame, which would be extruded from a metal or plastic material having a spring characteristic, to which spaced portions of such a pad could be removably clamped between flanged portions of the frame and adjacent portions of the frame, and which could be removably clamped over a sponge mop. The flanged and adjacent portions of the frame would be spring-biased toward each other, because of the spring characteristic of the material of the frame, so as to impart a clamping force on such spaced portions of the pad. It has been considered, however, that such a proposal would not be entirely satisfactory in that the pad would not be well attached to the frame and could be easily dislodged. It has been proposed, as an alternative approach, to affix such a pad to a frame, which would be extruded from a metal or plastic material having a spring characteristic and which could be removably clamped over a sponge mop, by means of an adhesive. It has been considered, however, that use of an adhesive to affix such a pad to a frame would be too expensive and too complicated, from a manufacturing standpoint.

There has been a need, to which this invention is addressed, for an improved, inexpensive, and uncomplicated way to combine such a pad with a sponge mop.

SUMMARY OF THE INVENTION

It is a principal object of this invention to provide an improvement in a combination comprising a sponge mop, a pad, and means comprising a frame adapted to be removably attached to the sponge mop for removably attaching the pad to the sponge mop. The improvement provides a better way to attach the compressible pad to the frame. The pad may be a scrubbing pad, a polishing pad, or a pad designed for a purpose other than scrubbing or polishing. Broadly, the means for removably attaching the pad to the sponge mop comprises a frame and a locking member.

In a preferred embodiment, in which the pad is a compressible pad, the frame, which is adapted to be removably attached to the sponge mop, is provided with integral structure forming one part of a two-part interlocking assembly, which is adapted to removably attach the pad to the frame. The locking member, which forms the other part of assembly, is adapted to interlock with the first-mentioned part of the assembly so as to compress a portion of the pad between the interlocked parts of the assembly.

Preferably, the assembly noted in the preceding paragraph is one of a pair of similar assemblies, which are adapted to removably attach the pad to spaced portions of the frame respectively at spaced portions of the pad, the other assembly of the pair having a locking member similar the locking member of the first-mentioned assembly of the pair.

Preferably, each locking member is an integral part of the frame, which may be a plastic extrusion. Alternatively, the frame and each locking member may be discrete parts, which may be plastic extrusions. Polyvinyl chloride, which is extrudible and which has a spring characteristic, is a preferred material for the frame and for each locking member.

In an alternate embodiment, in which the pad may but does not have to be compressible, all parts are similar except that the frame and the locking member are discrete parts and the locking member, which forms the other part of the assembly, is affixed adhesively or otherwise to the pad and adapted to interlock with the first-mentioned part of the assembly. The assembly may be one of a pair of similar assemblies adapted to attach spaced portions of the pad respectively to spaced portions of the frame.

These and other objects, features, and advantages of this invention will be better understood from the following description of a preferred and several alternative embodiments of this invention, with reference to the accompanying drawings.

DETAILED DESCRIPTION OF PREFERRED AND ALTERNATIVE EMBODIMENTS

Figure 2:
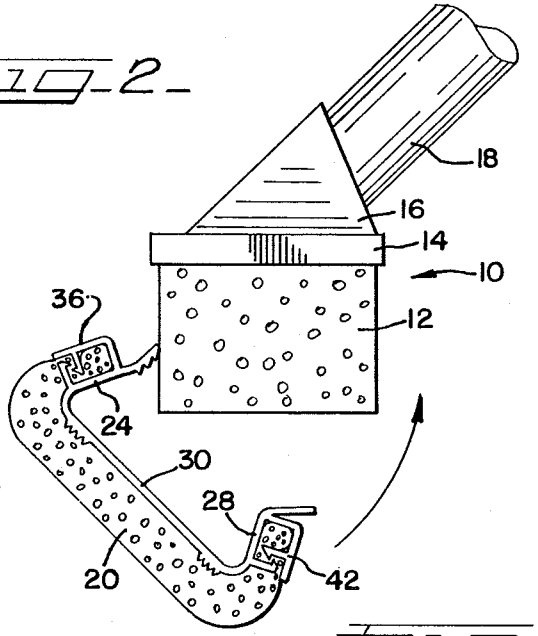
FIG. 2 is an end view showing the pad being removably attached to the sponge mop in the preferred embodiment of FIG. 1.
Figure 1:
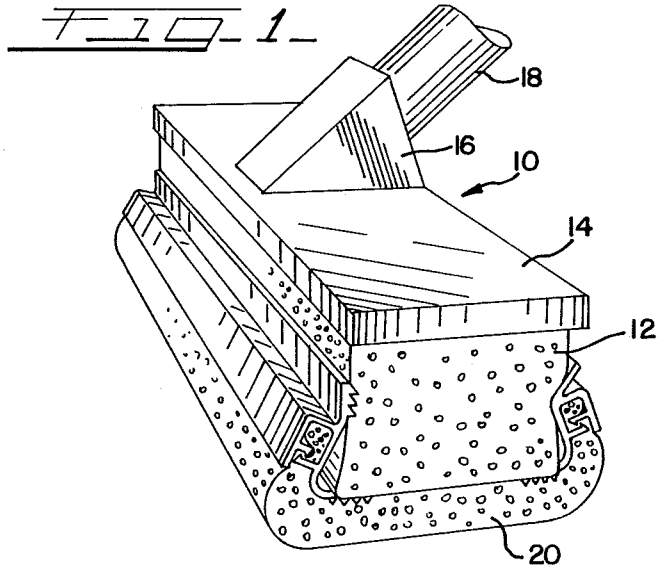
FIG. 1 is a perspective view of a sponge mop and a pad of compressible material, as combined in a preferred embodiment of this invention, a handle being shown fragmentarily.
Figure 3:
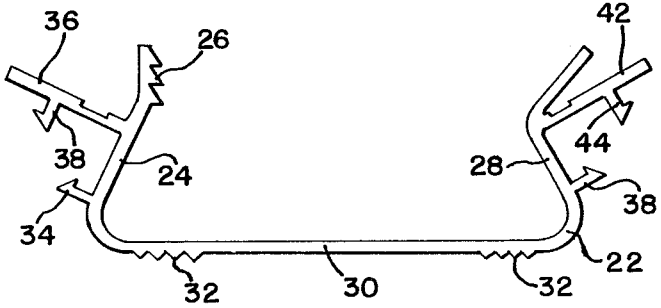
FIG. 3 is an end view of a frame used to removably attach the pad to the sponge mop in the preferred embodiment of FIG. 1.

As shown in FIGS. 1 and 2, a sponge mop 10 of a conventional type comprises a cellulose or other synthetic sponge 12 of rectangular parallelipipedal shape, a cover 14 made of molded plastic, affixed to the top surface of the sponge 12, and provided with an integral hub 16, and an elongated handle 18 secured at one end to the hub 16. The handle 18 is shown fragmentarily.

As shown in FIGS. 1 through 4, which illustrate a preferred embodiment of this invention, an external pad 20, which is made of a compressible material, and which may be a scrubbing pad, a polishing pad, or a pad designed for a purpose other than scrubbing or polishing, is removably attached to the sponge 12 in a novel manner according to this invention. The pad 20 may be a cellulose or other synthetic sponge, as shown, or any other pad made of a compressible material adapted to be removably attached to the sponge 12 in the same manner. The sponge 12 and the pad 20 may be made of similar or different materials. If the sponge 12 and the pad 20 are made of similar materials, the pad 20 may be regarded as an expendable cover, which can be used with cleansers containing fine particles of grit without risk that the sponge 12 will tear apart or crumble.

Specifically, a frame 22 is generally U-shaped, as shown. The flange 22 has a flange 14, which has a bowed shape, as shown, a portion of which is formed on the inner surface of an upper portion of the flange 14 with a plurality of longitudinal serations 26, and another flange 28, which also has a bowed shape, as shown, but which does not have such serrations. A base 30 of the frame 22 is formed on its outer face with two sets of longitudinal serrations 32. The frame 22 is adapted to be removably clamped over the sponge 12 such that the flange 24 bears against one of the front and back surfaces of the sponge 12, such that the flange 28 bears against the other of the front and back surfaces of the sponge 12, and such that the base 30 of the frame 22 bears against the bottom surface of the sponge 12. The serrations 26 on the flange 24 help to secure the frame 22 to the sponge 12.

Figure 4:
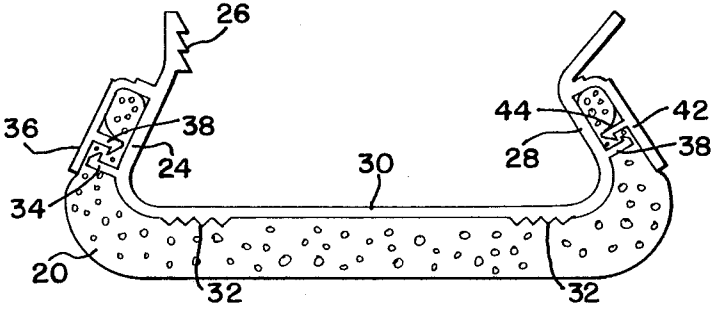
FIG. 4 is an end view of the frame of FIG. 3 with the pad removably attached to the frame.

The frame 22 is provided with integral structure forming a hook 34, which projects outwardly from the outer surface of the flange 24. A locking member 36, which also is an integral part of the frame 122, forms a hook 38, which is adapted to interlock with the hook 34 so as to compress a first edge portion of the pad 20 between the interlocked hooks 34, 38, as shown in FIGS. 1, 2, and 4. The integral structure forming the hook 34 and the locking member 36 forming the hook 38 constitute the two parts of a first two-part interlocking assembly.

The frame 22 is provided with integral structure forming a hook 38, which is similar to the hook 34, but which projects outwardly from the outer surface of the flange 28. A locking member 42, which also is an integral part of the frame 22, forms a hook 44, which is adapted to interlock with the hook 38 so as to compress a second edge portion of the pad 20 between the interlocked hooks 38, 44, as shown in FIGS. 1, 2, and 4. The integral structure forming the hook 38 and the locking member 42 forming the hook 44 constitute the two parts of a second two-part interlocking assembly.

When the first and second edge portions of the pad 20 are compressed respectively between the interlocked hooks 34, 38, of the first two-part interlocking assembly and between the interlocked hooks 38, 44, of the second two-part interlocking assembly, the pad 20 is removably attached to the frame 22. The serrations 32 on the base 30 of the frame 22 help to stabilize the pad 20 in relation to the frame 22.

After the pad 20 has been removably attached to the frame 22, the frame 22 and the attached pad 20 may be removably attached to the sponge 12, which when compressed slightly between its front and back surfaces fits between the flange 24 and the flange 28. FIG. 2 shows the frame 22 and the attached pad 20 being moved in a sense indicated by an arrow, so as to be so attached to the sponge 12. The serrations 26 on the flange 24 help to stabilize the sponge 12 in relation to the frame 22. As indicated in FIG. 1, an upper portion of the flange 28 is disposed at such an angle relative to the back surface of the sponge 12 as to enable a user readily to press on the upper portion of the flange 28 so as to quickly remove the frame 22 and the pad attached to the frame 22 from the sponge mop 10.

The frame 22 including the flanges 24, 28, and the hooks 34, 38, may be extruded from a suitable plastic, such as polyvinyl chloride, with a spring characteristic, which enables the flange 24, 28, to clamp against the sponge 12, and which allows the frame 22 to be repeatedly attached and removed without cracking or other failure of the frame 22.

Except as described below, each of the alternative embodiments illustrated in FIGS. 5 through 8 is similar to the preferred embodiment illustrated in FIGS. 1 through 4 and described above.

Figure 5:
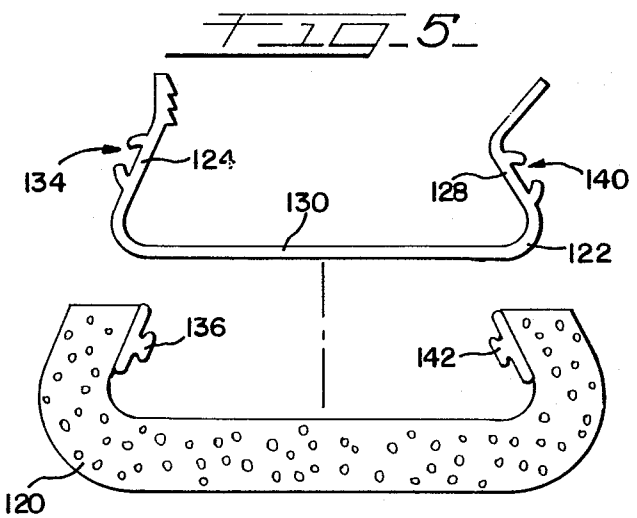
FIG. 5 is an end view of a frame, a pad, and two locking members, which when combined constitute an alternative embodiment of this invention.

In an alternative embodiment shown in FIG. 5, a pad 120 is adapted to be removably attached to a frame 122, which is like the frame 22 except that, in the alternative embodiment shown in FIG. 5, the base 130 of the frame 122 does not have any serrations and integral structures on the flanges 124, 128 of the frame 122 provide the female profiles 134, 140, which interlock respectively with the male profiles 136, 142, the male profiles 136, 142, being affixed respectively to spaced portions of the pad 120. The male profiles 136, 142, may be adhesively affixed to the pad 120. The female profile 134 and the male profile 136 constitute the two parts of a first two-part interlocking assembly. The female profile 140 and the male profile 142 constitute the two parts of a second two-part interlocking assembly. Such assemblies, in which the male profiles 136, 142, are the locking members, are used to removably attach spaced portions of the pad 120 to spaced portions of the frame 122. Although it may be possible for the male profile 136 to be snapped into and out from the female profile 136 and for the male profile 142 to be snapped into and out from the female profile 140, it may be easier to slide the male profiles 136, 142, longitudinally onto and off from the female profiles 136, 140. The frame 122 and each of the male profiles 136, 142, are discrete parts, which may be separate extrusions of a suitable plastic, such as polyvinyl chloride, which has a spring characteristic, as noted above.

Figure 6:
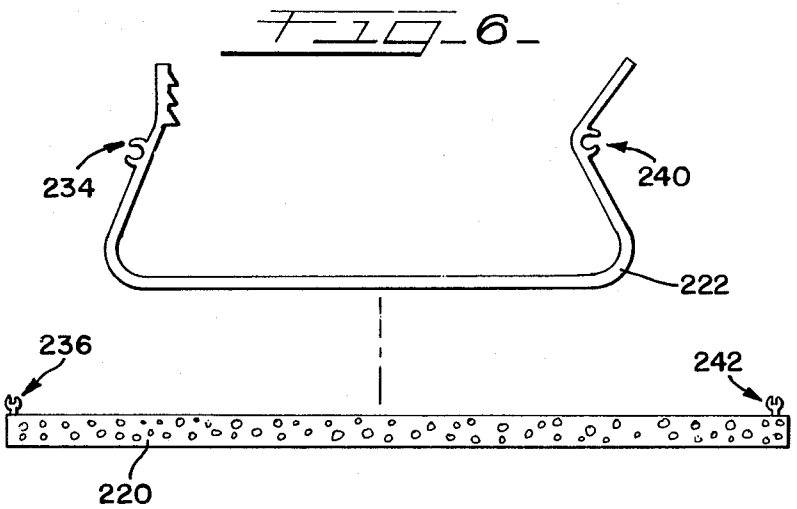
FIG. 6 is an end view of a frame, a pad, and two locking members, which when combined constitute another alternative embodiment of this invention.

An alternative embodiment shown in FIG. 6 is similar to the alternative embodiment shown in FIG. 5 except that, in the alternative embodiment shown in FIG. 5, the male profiles 236, 242, which are affixed respectively to spaced portions of the pad 220, are bifurcated, as shown, and the female profiles 234, 240, which are formed by integral structures on the frames 222, are shaped accordingly, so as to facilitate snapping of the male profile 236 into and out from the female profile 234 and so as to facilitate snapping of the male profile 242 into and out from the female profile 240.

Figure 7:
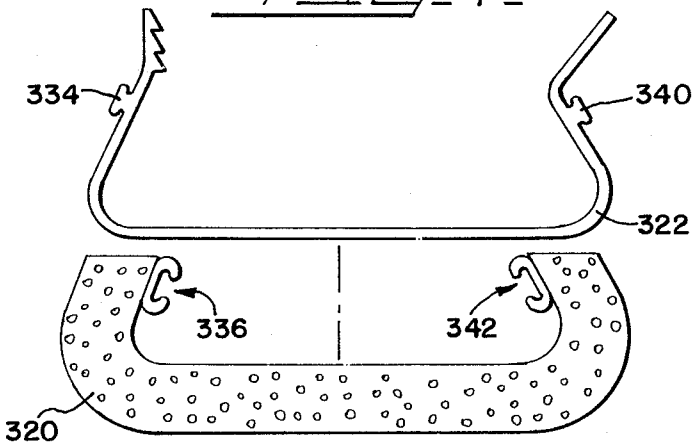
FIG. 7 is an end view of a frame, a pad, and two locking members, which when combined constitute another alternative embodiment of this invention.

The alternative embodiment shown in FIG. 7 is similar to the alternative embodiment of FIG. 5 except that, in the alternative embodiment of FIG. 7, the male profiles 334, 340, are provided by integral structures on the frame 322 and the female profiles 336, 342, are affixed respectively to spaced portions of the pad 320.

Figure 8:
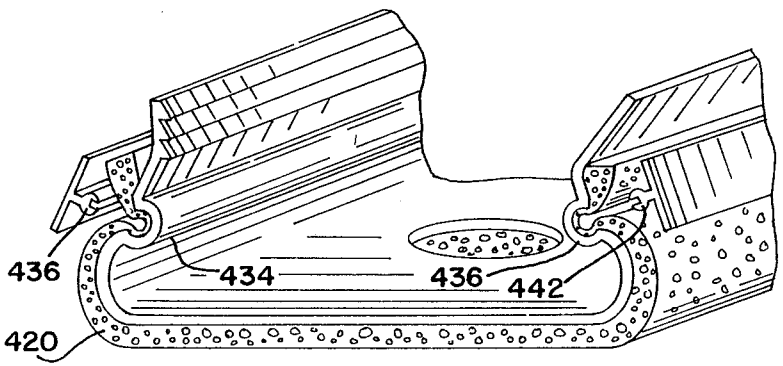
FIG. 8 is a perspective view of fragmentary portions of a frame, a pad of compressible material, and two locking members, which when combined constitute another alternative embodiment of this invention.

The alternative embodiment shown in FIG. 8 is similar to the preferred embodiment shown in FIGS. 1 through 4 in that each of a pair of two-part interlocking assemblies compresses a portion of a pad. However, in the alternative embodiment shown in FIG. 8, integral structures on the frame 422 provide female profiles 434, 440, which coact with discrete parts providing male profiles 436, 442. The male profiles 436, 442, are bifurcated, as shown, so as to facilitate interlocking between the male profile 436 and the female profile 430 with an edge portion of the pad 420 therebetween, and so as to facilitate interlocking of the male profile 442 and the female profile 440 with an edge portion of the pad 420 therebetween.

It is intended by the following claims to cover such modifications and variations as come within the scope and spirit of this invention.

I claim:

1. In a combination comprising a sponge mop, a compressible pad, and means for removably attaching the pad to the sponge mop, said means comprising a frame adapted to be removably attached to the sponge mop, an improvement wherein the frame is provided with integral structure forming one part of a two-part interlocking assembly adapted to removably attach the pad to the frame and wherein a locking member forms the other part of said assembly, the locking member being adapted to interlock with said one part of said assembly so as to compress a portion of the pad between the interlocked parts of said assembly.

2. The combination of claim 1 wherein the locking member is an integral part of the frame.

3. The combination of claim 2 wherein each of said parts of said assembly forms a hook and wherein the hooks are adapted to interlock with each other.

4. The combination of claim 1 wherein said assembly is one of a pair of similar assemblies adapted to removably attach spaced portions of the pad respectively to spaced portions of the frame, the other assembly of said pair having a locking member similar to the locking member of said one assembly of said pair.

5. The combination of claim 4 wherein each of the locking members is an integral part of the frame.

6. The combination of claim 4 wherein the frame and each of the locking members are discrete parts.

7. The combination of claim 6 wherein each of the locking members is affixed to the pad.

8. Ine combination of claim 6 wherein the frame and each of the locking members are plastic extrusions.

9. The combination of claim 1 wherein the frame and the locking member are discrete parts.

10. The combination of claim 9 wherein the locking member is affixed to the pad.

11. The combination of claim 9 wherein the frame an locking member are plastic extrusions.

12. In a combination comprising a sponge mop, a pad, and means for removably attaching the pad to the sponge mop, said means comprising a frame adapted to be removably attached to the sponge mop, an improvement wherein the frame is provided with integral structure forming one part of a two-part interlocking assembly adapted to removably attach the pad to the frame and wherein a locking member is affixed to the pad, the locking member forming the other part of said assembly and being adapted to interlock with said one part of said assembly.

13. The combination of claim 12 wherein said assembly is one of a pair of similar assemblies adapted to removably attach spaced portions of the pad to spaced portions of the frame.

* * * * *